US009429292B2

(12) United States Patent
Choi et al.

(10) Patent No.: US 9,429,292 B2
(45) Date of Patent: Aug. 30, 2016

(54) LAMP ASSEMBLY FOR VEHICLE

(71) Applicant: SL Corporation, Daegu (KR)

(72) Inventors: Kook Young Choi, Gyeongsangbuk-Do (KR); Kwan Ho Lim, Gyeongsangbuk-Do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 14/015,255

(22) Filed: Aug. 30, 2013

(65) Prior Publication Data

US 2014/0146555 A1 May 29, 2014

(30) Foreign Application Priority Data

Nov. 28, 2012 (KR) ..... 10-2012-0136243

(51) Int. Cl.
*F21V 5/00* (2015.01)
*F21S 8/10* (2006.01)

(52) U.S. Cl.
CPC ..... *F21S 48/2212* (2013.01); *F21S 48/1104* (2013.01); *F21S 48/1216* (2013.01); *F21S 48/1266* (2013.01); *F21S 48/1283* (2013.01); *F21S 48/142* (2013.01); *F21S 48/321* (2013.01); *F21S 48/328* (2013.01)

(58) Field of Classification Search
CPC ..... F21S 48/1154; F21S 48/1266; F21S 48/2212; F21S 48/1225; F21S 48/125; F21S 48/10; F21S 48/1216; F21V 5/04; B60Q 1/04
USPC ..... 362/336, 487, 507, 509, 520, 521, 522, 362/538, 338, 498, 544
See application file for complete search history.

(56) References Cited

U.S. PATENT DOCUMENTS

| | | | | |
|---|---|---|---|---|
| 6,866,405 | B2 * | 3/2005 | Smith | G02B 3/06 235/462.35 |
| 7,736,036 | B2 | 6/2010 | Tatsukawa | |
| 8,075,166 | B2 | 12/2011 | Ohno et al. | |
| 2004/0125613 | A1 * | 7/2004 | Hasegawa et al. | 362/507 |
| 2004/0208018 | A1 * | 10/2004 | Sayers et al. | 362/544 |
| 2006/0007692 | A1 * | 1/2006 | Hsien | B60Q 1/263 362/382 |
| 2007/0236952 | A1 * | 10/2007 | Chinniah et al. | 362/538 |
| 2008/0316761 | A1 * | 12/2008 | Minano et al. | 362/518 |
| 2012/0057353 | A1 * | 3/2012 | Wei | F21V 5/007 362/311.09 |
| 2012/0189291 | A1 * | 7/2012 | Von Malm | G03B 15/05 396/157 |

FOREIGN PATENT DOCUMENTS

| | | | |
|---|---|---|---|
| JP | 2009-199938 | A | 9/2009 |
| KR | 10-2012-0029883 | A | 3/2012 |

* cited by examiner

*Primary Examiner* — Andrew Coughlin
*Assistant Examiner* — Meghan Ulanday
(74) *Attorney, Agent, or Firm* — Mintz Levin Cohn Ferris Glovsky and Popeo, P.C.; Kongsik Kim; Colleen H. Witherell

(57) ABSTRACT

The lamp assembly for a vehicle according to an embodiment of the present invention includes a light source unit configured to irradiate light, and a lens unit configured to emit the light from the light source unit toward the outside of the lamp assembly. More specifically, the lens unit includes a non-circular-shaped lens on which a light intensity adjusting portion, which adjusts intensity of the light emitted in a lateral side direction, is formed.

6 Claims, 10 Drawing Sheets

LAMP ASSEMBLY FOR VEHICLE

CROSS-REFERENCE TO RELATED APPLICATION

This application claims priority from Korean Patent Application No. 10-2012-0136243 filed on Nov. 28, 2012 in the Korean Intellectual Property Office, and all the benefits accruing therefrom under 35 U.S.C. 119, the contents of which in its entirety are herein incorporated by reference.

BACKGROUND

The present invention relates to a lamp assembly for a vehicle, and more particularly, to a lamp assembly for a vehicle that adjusts the intensity of light, when irradiated in an undesired direction, through a simple structure.

In general, a vehicle is provided with various lamps for illuminating various areas around and within the vehicle. These lamps allow a driver to easily identify objects within the periphery of the vehicle when the vehicle is driven at night, and provide a signal function that informs other drivers or persons around the vehicle of a driving state of the vehicle. For example, a head lamp, a fog lamp, and the like are mainly provided for the purpose of providing light, and a turn signal lamp, a tail lamp, a brake lamp, a side marker, and the like are provided for the purpose of signaling. In general, as the lamp for a vehicle, a light source such as a halogen lamp or a high intensity discharge (HID) lamp are commonly used.

Recently, however, as the light source, light emitting diodes have started to be used in lamp assembly. These light emitting diodes have a color temperature of about 5,500 K, which is close to a color temperature of sun light, so as to reduce eye strain that causes fatigue. In addition, light emitting diodes minimize the size of the lamp that is required thus increasing the degree of design freedom of the lamp, and also increasing the economic efficiency because light emitting diodes typically have a semi-permanent lifespan.

That is, an attempt has been made to overcome a complicated configuration of the lamp and increased process steps in the related art by introducing the light emitting diode into the lamp assembly. As a result, there is a tendency to overcome reduced lifespan of the lamps by using the light emitting diode as well as reduce the amount of space required by the light source in the lamps.

In particular, lamps for a vehicle may be configured of a plurality of lamp assemblies for a vehicle, which are arranged in one direction, in accordance with a layout thereof or a quantity of light, and may use a non-circular-shaped lens in order to prevent structural interference between the lamp assemblies of the vehicle, which are adjacent to each other.

Here, when a lens has a non-circular shape, the amount of light emitted in a lateral side direction of the lens, among the light emitted from the lens, is increased so that the light emitted from the respective lamp assemblies for a vehicle may affect another adjacent lamp assembly within the vehicle, and therefore. As such, light interference is often prevented by using a bezel or a separate member.

However, when the bezel or the separate member is utilized, the configuration becomes complicated and manufacturing costs are increased, and therefore, a method is required which may simplify the configuration and prevent the light interference between the lamp assemblies for a vehicle due to the light emitted from each of the lamp assemblies for a vehicle.

SUMMARY

The present invention has been made in an effort to provide a lamp assembly for a vehicle that prevents light interference between the lamp assemblies of a vehicle that are adjacent to each other by using a lens that adjusts the intensity of light emitted in a lateral side direction.

An exemplary embodiment of the present invention provides a lamp assembly for a vehicle, including: a light source unit configured to irradiate light; and a lens unit configured to emit the light from the light source unit toward the outside of the lamp assembly. More specifically, the lens unit includes a non-circular-shaped lens on which a light intensity adjusting portion, which adjusts intensity of the light emitted in a lateral side direction, is formed.

According to the lamp assembly for a vehicle of the present invention, as described above, there are one or more effects as follows.

By forming a knurling structure, which may adjust intensity of light irradiated in a lateral side direction, on the lens, the intensity of the light, which is emitted in an undesired direction, may be adjusted without using a separate member (such as a bezel), and therefore, the configuration is simplified, and light interference between the lamp assemblies for a vehicle, which are adjacent to each other, may be prevented.

The effects of the present invention are not limited to the aforementioned effects, and other effects, which are not mentioned above, will be apparently understood by the person skilled in the art from the recitations of the claims.

BRIEF DESCRIPTION OF THE DRAWINGS

The above and other features and advantages of the present invention will become more apparent by describing in detail embodiments thereof with reference to the attached drawings in which.

DETAILED DESCRIPTION OF THE EMBODIMENTS

Figure 1:
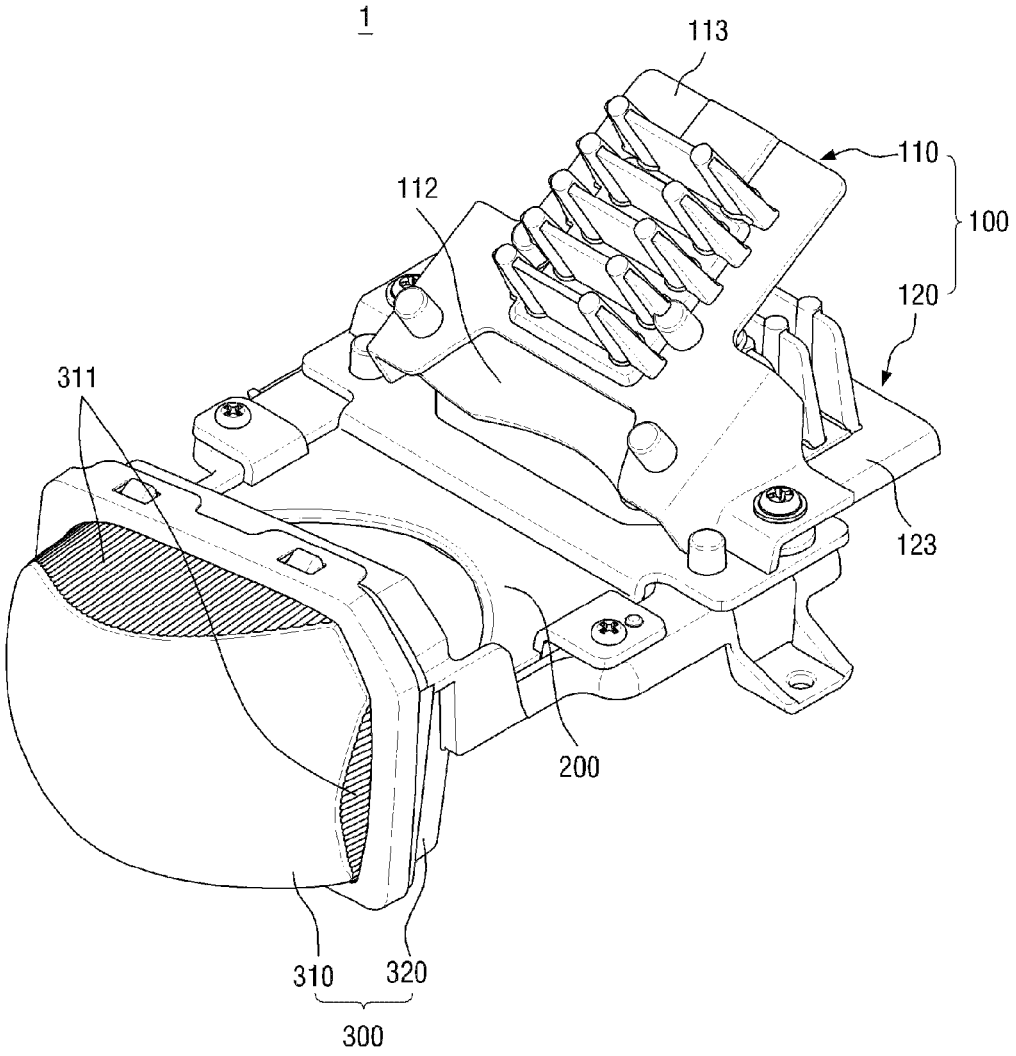
FIG. 1 is a perspective view illustrating a lamp assembly for a vehicle according to an exemplary embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, the present invention will be described with reference to the drawings for explaining a lamp assembly for a vehicle according to embodiments of the present invention.

Figure 2:
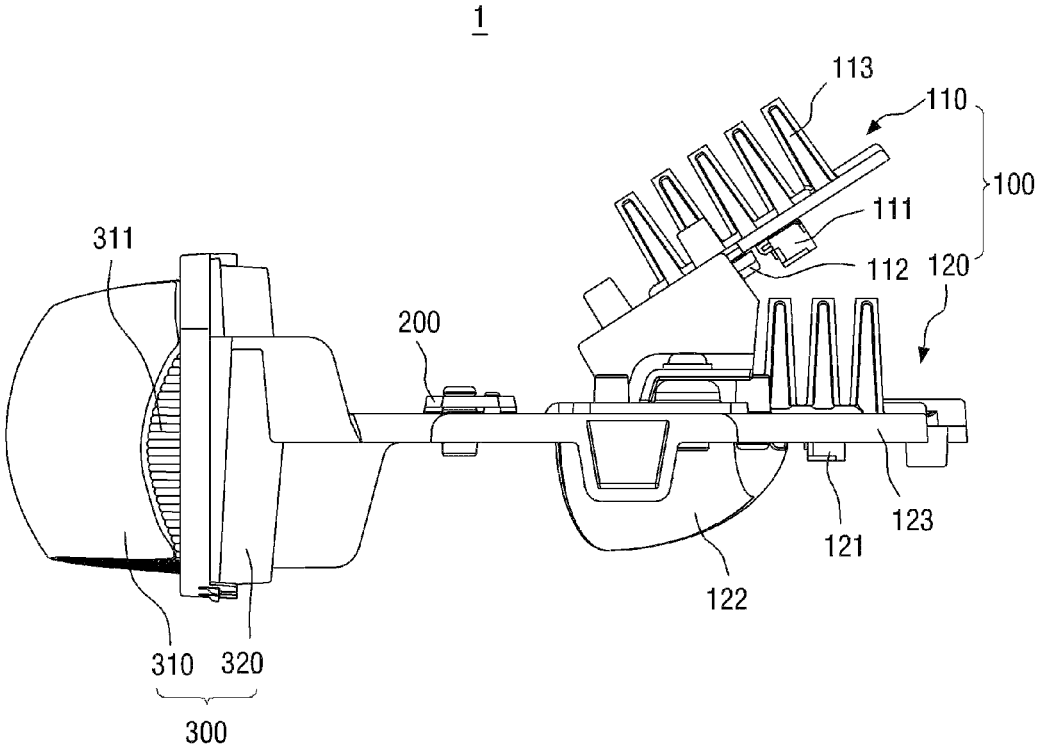
FIG. 2 is a side view illustrating the lamp assembly for a vehicle according to the exemplary embodiment of the present invention.
Figure 3:
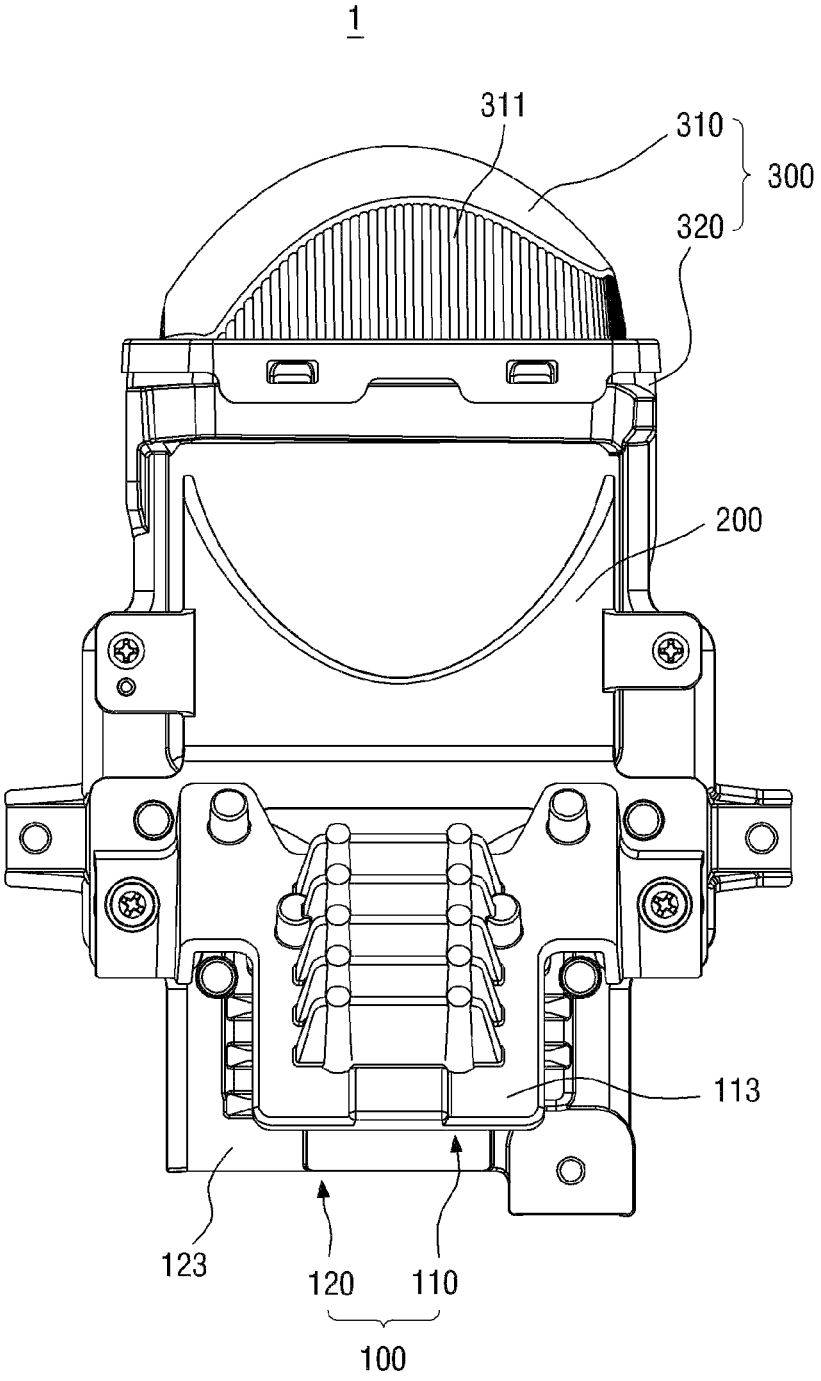
FIG. 3 is a plan view illustrating the lamp assembly for a vehicle according to the exemplary embodiment of the present invention.

FIG. 1 is a perspective view illustrating a lamp assembly for a vehicle according to an exemplary embodiment of the present invention, FIG. 2 is a side view illustrating the lamp assembly for a vehicle according to the exemplary embodiment of the present invention, and FIG. 3 is a plan view illustrating the lamp assembly for a vehicle according to the exemplary embodiment of the present invention.

As illustrated, a lamp assembly 1 for a vehicle according to an exemplary embodiment of the present invention may include light source units 100, a shield unit 200, and a lens unit 300.

In the exemplary embodiment of the present invention, an example is described in which the light source unit 100 is positioned at both sides, respectively, for example, an upper side and a lower side in relation to an optical axis of the lens unit 300, respectively, and used to form different light irradiation patterns, but this example is merely for better understanding of the present invention, the present invention is not limited thereto, and one or more light source units 100 may be used in accordance with a light irradiation pattern to be formed.

In the exemplary embodiment of the present invention, an example is described in which the light source unit 100 includes a first light source unit 110 and a second light source unit 120, and the first light source unit 110 is disposed at an upper side in relation to the optical axis of the lens unit 300, and the second light source unit 120 is disposed at a lower side in relation to the optical axis of the lens unit 300.

The first light source unit 110 in the exemplary embodiment of the present invention may include a first light source 111 configured to irradiate light, a first reflector 112 configured to reflect the light irradiated from the first light source 111 toward a front side, and a first heat sink 113 configured to prevent an increase in temperature due to heat generated from the first light source 111.

Similarly to the first light source unit 110, the second light source unit 120 may also include a second light source 121 configured to irradiate light, a second reflector 122 configured to reflect the light irradiated from the second light source 121 toward a front side, and a second heat sink 123 configured to prevent an increase in temperature due to heat generated from the second light source 121.

In the exemplary embodiment of the present invention, an example is described in which a semiconductor light emitting element, for example, a light emitting diode (LED) is used as the first light source 111 and the second light source 121, but the present invention is not limited thereto, and a bulb light source may be used. The first light source 111 and the second light source 121 may have identical or different colors and are configured as a plurality in accordance with a use and a quantity of light, and when different colors are used, a plurality of functions may be implemented using a single lamp. In addition, the first reflector 112 and the second reflector 122 may be configured as a plurality or may be used in common in accordance with the number of the first light sources 111 and the second light sources 121.

In the exemplary embodiment of the present invention, an example is described in which the first heat sink 113 and the second heat sink 123 include a plurality of heat emitting fins which are extended in one side direction from the first light source 111 and the second light source 122, but the present invention is not limited thereto, and the first heat sink 113 and the second heat sink 123 may have the form of a heat pipe or a heat spread, and a heat pad may be formed on the surfaces where the first light source 111 and the second light source 121 come into contact with the first heat sink 113 and the second heat sink 123, respectively, so as to increase a thermal conductivity.

In addition, in the exemplary embodiment of the present invention, an example is described in which the first heat sink 113 and the second heat sink 123 are used to prevent an increase in temperature due to heat generated from the first light source 111 and the second light source 121, but a cooling apparatus such as a cooling fan may be used together with the first heat sink 113 and the second heat sink 123.

The shield unit 200 has a horizontal shape, and is disposed at a front side of the light source unit 100 and may block a part of the light irradiated from the light source unit 100 so as to form a light irradiation pattern, and may have a front end which is positioned in the vicinity of a rear focal point of the lens unit 300 and formed to be extended toward a rear side, and the front end of the shield unit 200 may be formed in the form of a curved line so that the front end is slowly displaced along a read focal surface of the lens unit 300 toward both sides of the lens unit 300.

The lens unit 300 may include a lens 310, and a lens holder 320 configured to support the lens 310, and in the exemplary embodiment of the present invention, an example is described in which the lens holder 320 is integrally formed with at least one of the first heat sink 113 and the second heat sink 123, but this example is merely for better understanding of the present invention, the present invention is not limited thereto, and the lens holder 320 may be separately configured.

In addition, in the exemplary embodiment of the present invention, an example is described in which a non-circular-shaped aspherical lens having various curvatures in accordance with a light irradiation range or a light irradiation direction is used as the lens 310, and a light intensity adjusting portion 311, which may adjust intensity of light that is emitted toward the outside of the lamp assembly, may be formed at a lateral side of the lens 310.

Figure 4:
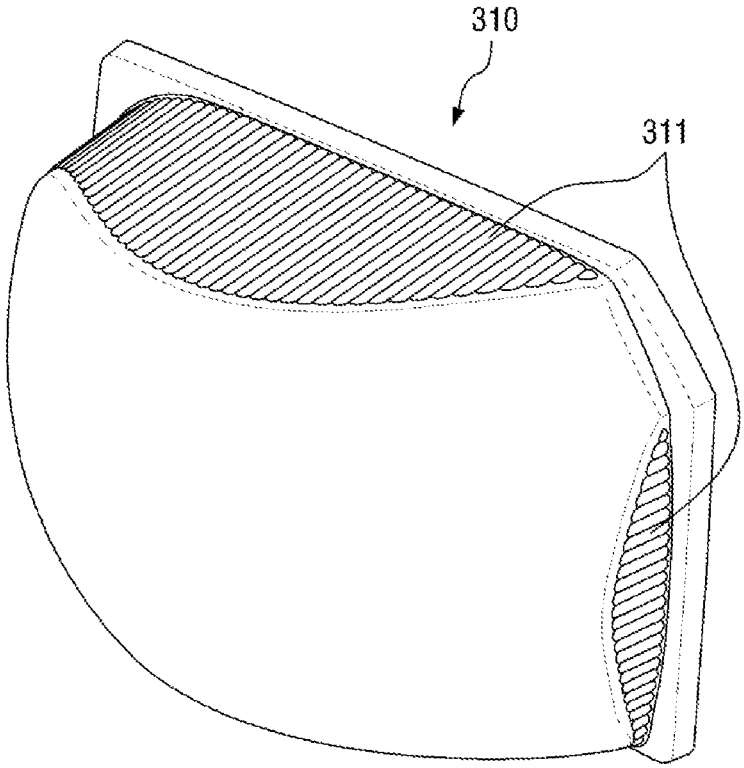
FIG. 4 is a perspective view illustrating a lens according to the exemplary embodiment of the present invention.
Figure 5:
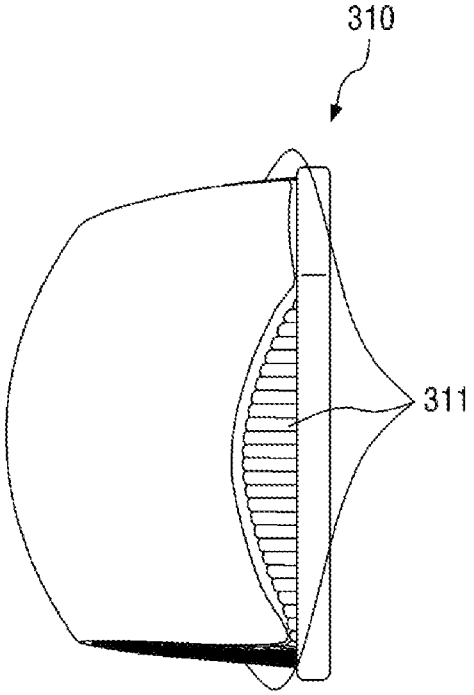
FIG. 5 is a side view illustrating the lens according to the exemplary embodiment of the present invention.

FIG. 4 is a perspective view illustrating a lens according to the exemplary embodiment of the present invention, and FIG. 5 is a side view illustrating the lens according to the exemplary embodiment of the present invention. As illustrated, in the lens 310 according to the exemplary embodiment of the present invention, the light intensity adjusting portion 311, which adjusts intensity of light, may be formed at a lateral side of an emitting surface through which the light is emitted toward the outside.

In the exemplary embodiment of the present invention, an example is described in which the lens 310 has a non-circular shape, for example, an approximately quadrangular shape when viewed from the front side, but the shape of the lens 310 may be variously changed in consideration with a layout of the lamp for a vehicle, and structural interference with other adjacent lamp assemblies for a vehicle.

The light intensity adjusting portion 311 may be formed in a direction of the light of which the intensity needs to be attenuated, among the light which is emitted through the lens 310 toward the outside, and in the exemplary embodiment of the present invention, an example is described in which the light intensity adjusting portion 311 is formed in one or more directions of lateral side directions of the lens 310.

In other words, in order to prevent the light emitted from the lamp assembly 1 for a vehicle according to the exemplary embodiment of the present invention from affecting another lamp assembly for a vehicle that is adjacent to the lamp assembly 1 for a vehicle in at least one direction of the lateral side directions of the lamp assembly 1 for a vehicle, the light intensity adjusting portion 311 may attenuate the intensity of the light that is emitted in a lateral side direction.

Therefore, in the lens 310 according to the exemplary embodiment of the present invention, the light having high intensity is emitted toward the front side, but the light having relatively low intensity is emitted in the lateral side direction, in which the light intensity adjusting portion 311 is formed, due to diffusion or scattering of the emitted light.

The light intensity adjusting portion 311 may be formed to have a knurling structure in order to diffuse or scatter the light that is emitted toward the outside, and in the exemplary embodiment of the present invention, an example is described in which the knurling structure is formed in a pattern in which the knurls are arranged in parallel to each other in one direction, but this example is merely for better understanding of the present invention, the present invention is not limited thereto, and the light intensity adjusting portion 311 may be formed in various patterns such as a point pattern or a lattice pattern which may generate diffusion or scattering of the light.

The light intensity adjusting portion 311 may be integrally formed with the lens 310 in one or more directions of the lateral side directions of the lens 310 at the time of an injection molding process of the lens 310, or may be formed in one or more directions of the lateral side directions of the lens 310 through a deposition process or the like, and when the light intensity adjusting portion 311 is formed on the lens 310 through the injection molding process, the deposition process, or the like, the light intensity adjusting portion 311 may have the aforementioned forms of FIGS. 4 and 5.

Meanwhile, in the exemplary embodiment of the present invention, an example is described in which the light intensity adjusting portion 311 is formed on the lens 310 through the injection molding process, the deposition process, or the like, but this example is merely for better understanding of the present invention, the present invention is not limited thereto, and the light intensity adjusting portion 311 may be separately formed so as to be attached to the lateral sides of the lens 310 by means of an adhesive or the like, or may be formed through an etching process or the like after forming the lens 310.

Figure 6:
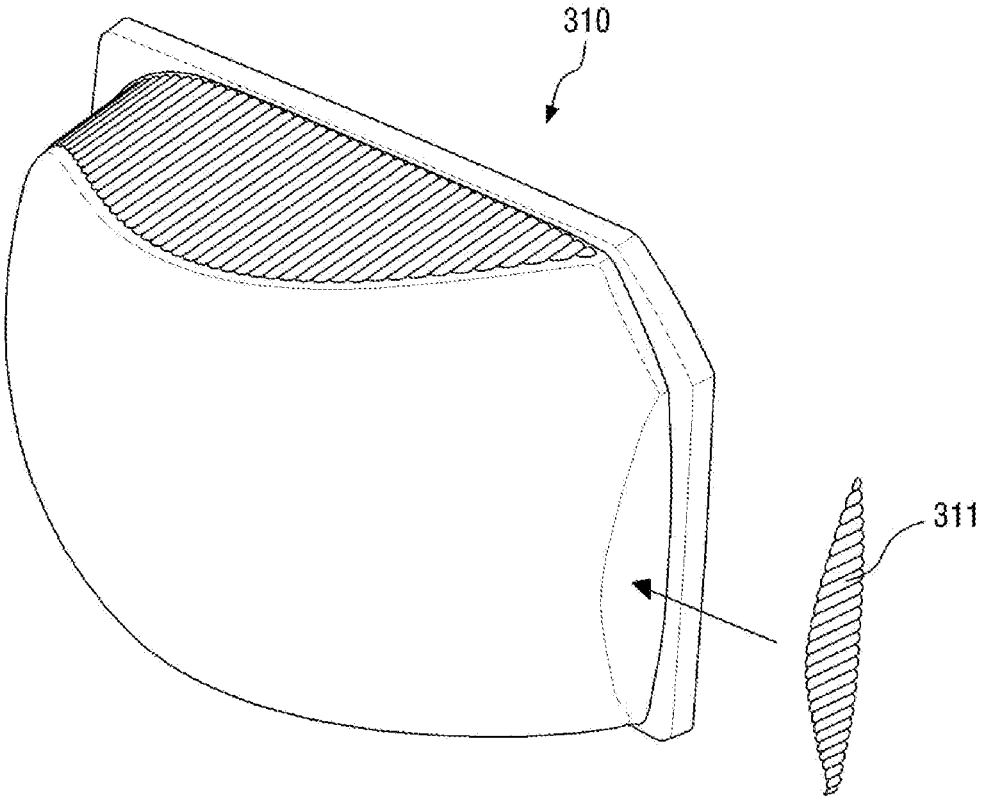
FIG. 6 is a perspective view illustrating a light intensity adjusting portion according to the exemplary embodiment of the present invention.

For example, as illustrated in FIG. 6, after the lens 310 and the light intensity adjusting portion 311 are separately formed, the adhesive is applied on the lateral side of the lens 310 which is formed in a direction in which intensity of light needs to be attenuated, and then the light intensity adjusting portion 311 may be attached to the portion on which the adhesive is applied. Here, in FIG. 6, an example is described in which the light intensity adjusting portion 311 is formed in one direction of the lateral side directions of the lens 310, but the light intensity adjusting portion 311 may be formed in the other directions, similarly to the above method.

Figure 7:
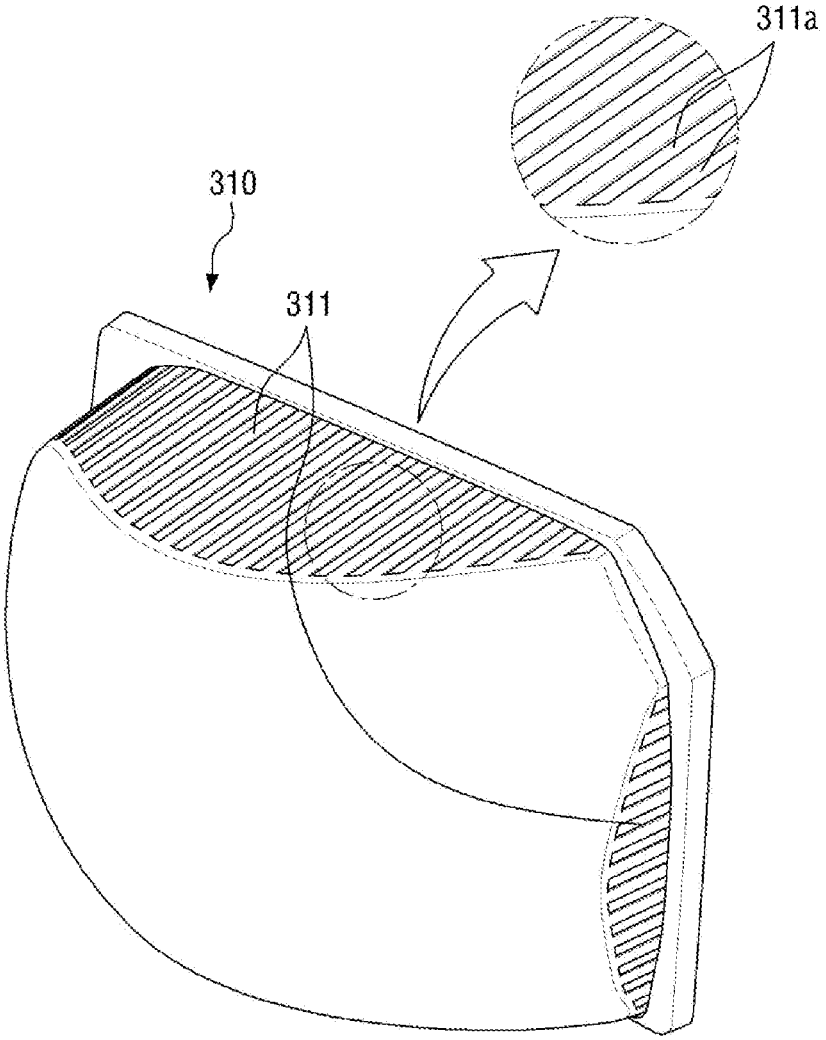
FIG. 7 is a perspective view illustrating a light intensity adjusting portion according to another exemplary embodiment of the present invention.

In addition, as illustrated in FIG. 7, the lens 310 is formed by the injection molding process or the like, and then the light intensity adjusting portion 311 may be formed by forming a plurality of grooves 311*a* on the lateral side of the lens 310, which is formed in a direction in which intensity of light needs to be attenuated, by the etching process or the like. Here, in the exemplary embodiment of the present invention, an example is described in which the plurality of grooves 311*a* is formed through the etching process, but this example is merely for better understanding of the present invention, the present invention is not limited thereto, and the grooves may be formed by a separate working tool.

The aforementioned various methods of forming the light intensity adjusting portion 311 are examples merely for better understanding of the present invention, the present invention is not limited thereto, and various methods may be used to form the knurling structure for diffusing or scattering the light that is emitted in the lateral side direction of the lens 310.

Figure 8:
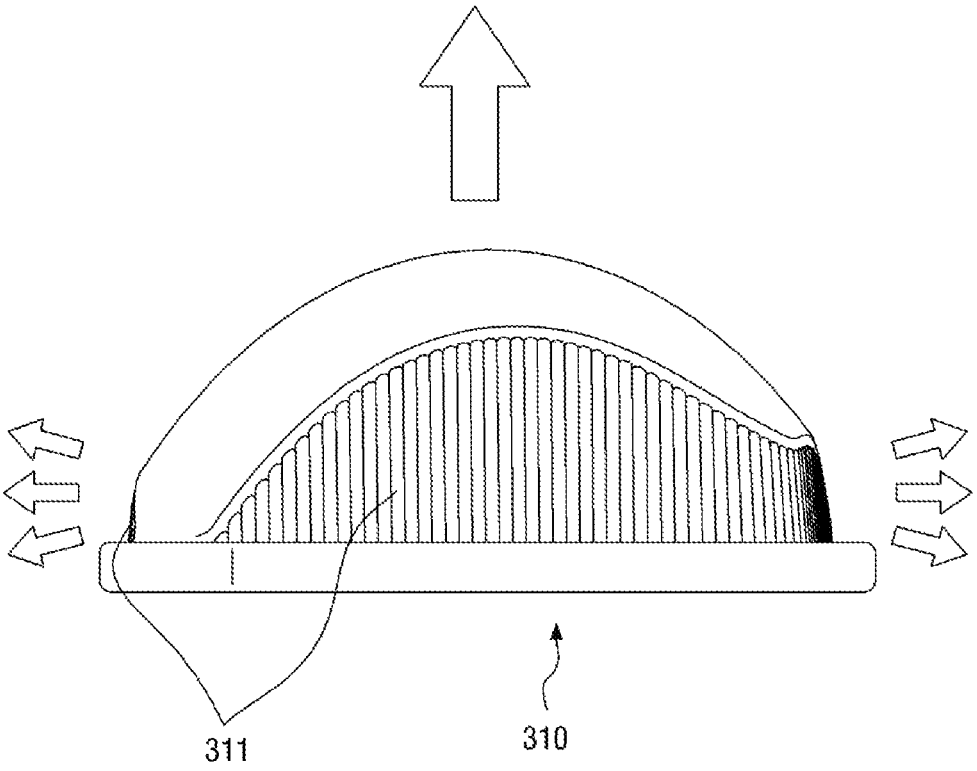
FIGS. 8 and 9 are schematic views illustrating intensity of light along a light emitting direction of the lens according to the exemplary embodiment of the present invention.
Figure 9:
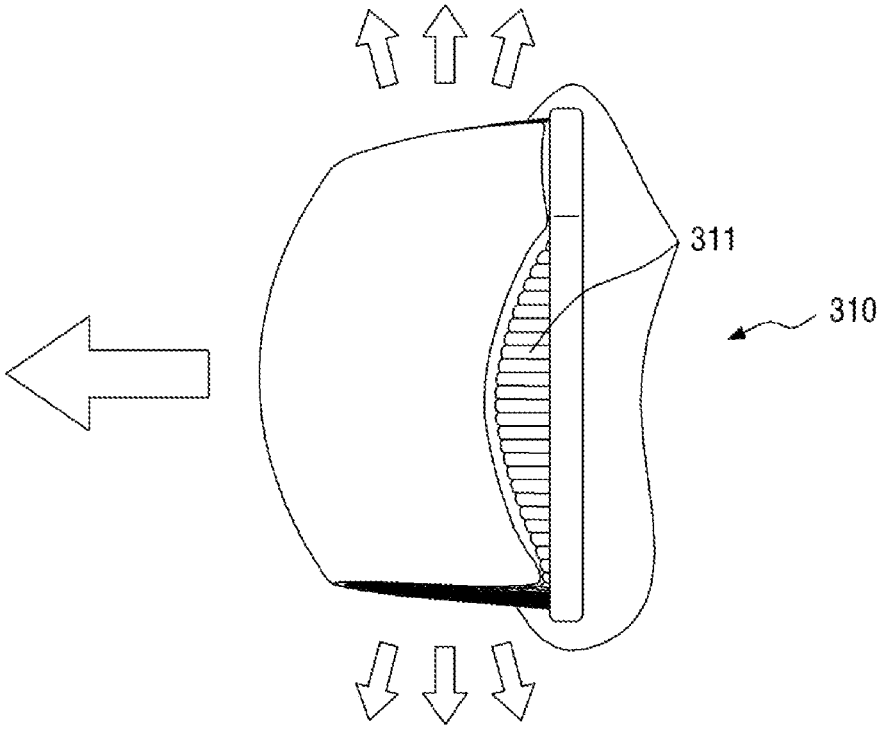

FIGS. 8 and 9 are schematic views illustrating intensity of the light emitted through the lens according to the embodiment of the present invention.

Referring to FIGS. 8 and 9, when the light entering the lens 310 is emitted, the intensity of the light emitted through the lateral side on which the light intensity adjusting portion 311 is formed may be relatively lower than the intensity of the light emitted through the front side on which the light intensity adjusting portion 311 is not formed, thereby preventing the light emitted from the lamp assembly 1 for a vehicle according to the exemplary embodiment of the present invention from affecting another lamp assembly for a vehicle that is adjacent to the lamp assembly 1 for a vehicle. Here, sizes of the arrows of FIGS. 8 and 9 indicate the intensity of the light emitted in the corresponding direction.

As such, in the exemplary embodiment of the present invention, by attenuating the intensity of the light emitted in the lateral side directions, that is, the other directions except for the direction which is necessary to secure a visual field, that is, a forward direction, among the light emitted through the lamp assembly 1 for a vehicle, it is possible to attenuate the intensity of the light which is emitted in an unnecessary direction, and a separate member for attenuating the intensity of the light emitted in an unnecessary direction is not used, thereby simplifying the structure.

Meanwhile, in the aforementioned exemplary embodiments of the present invention, an example of a type is described in which the light irradiation pattern in the lamp assembly 1 for a vehicle is formed by the shield unit 200, but the present invention is not limited thereto, and the aforementioned embodiment may also be similarly applied to a direct type in which the shield unit 200 is omitted, and the light, which is irradiated from the light source unit 100, is directly emitted toward the outside through the lens unit 300.

Figure 10:
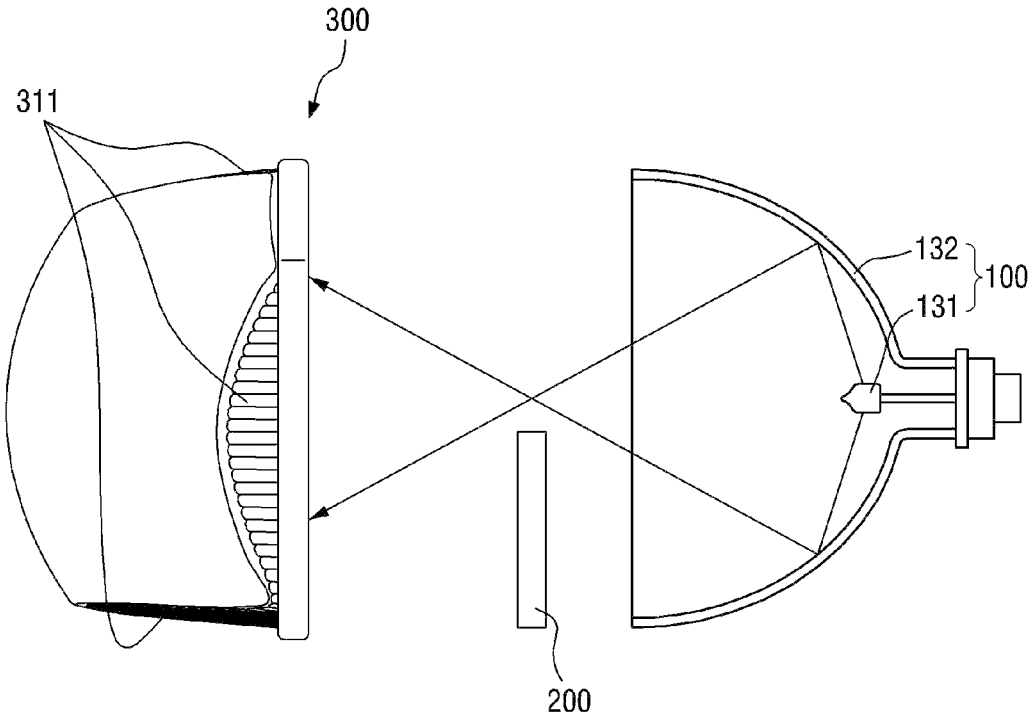
FIG. 10 is a schematic view illustrating a lamp assembly for a vehicle according to another exemplary embodiment of the present invention.

In addition, in the aforementioned exemplary embodiments of the present invention, an example is described in which the first light source 111 and the second light source 121 are an LED, and the shield unit 200 has a horizontal shape, but the present invention is not limited thereto, and as illustrated in FIG. 10, the bulb light source may be used as the light source 131 of the light source unit 100, the lens 310 formed with the aforementioned light intensity adjusting portion 311 may be used even in a case in which the light irradiation pattern is formed by blocking a part of the light using the shield unit 200 having a vertical shape when the light irradiated from the light source 131 is reflected by the reflector 132 and then irradiated toward the front side, and even in this case, as illustrated in FIGS. 8 and 9, the intensity of the light emitted in the lateral side direction may be attenuated.

The lamp assembly 1 for a vehicle according to the exemplary embodiment of the present invention is not limited to the aforementioned structures, and even in various structures which may be applied to the lamp assembly 1 for a vehicle, the light intensity adjusting portion 311 is formed on the lens 310, as described above, thereby attenuating the intensity of the light emitted in an unnecessary direction.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A lamp assembly for a vehicle, comprising:

a light source unit configured to irradiate light; and a lens unit having a non-circular-shaped lens configured to emit the light from the light source unit toward an outside of the lamp assembly, wherein the lens unit includes a light intensity adjusting portion formed on a lateral side of the lens unit, such that low intensity light passing through the light intensity adjusting portion emitted in a lateral side direction and high intensity light passing through a portion of the lens unit on which the light intensity adjusting portion is not formed is emitted in a front side direction, and wherein the light intensity adjusting portion includes a knurling structure formed at a side of the lens unit, wherein the knurling structure includes a first end that extends in a linear arrangement along an edge of the lens unit and a second end that forms an arc shape on a sidewall of the lens unit.

2. The lamp assembly of claim 1, wherein a light source of the light source unit is a light emitting diode (LED).

3. The lamp assembly of claim 1, further comprising:

a shield unit configured to block a portion of the light irradiated from the light source unit so as to form a light irradiation pattern.

4. The lamp assembly of claim 1, wherein the knurling structure has varying lengths.

5. The lamp assembly of claim 1, wherein the knurling structure is arranged in parallel to each other in one direction.

6. The lamp assembly of claim 1, wherein the knurling structure is arranged in a lattice pattern.

* * * * *